US008220651B2

(12) United States Patent
Norcom

(10) Patent No.: US 8,220,651 B2
(45) Date of Patent: Jul. 17, 2012

(54) CONTAINER INCLUDING REMOVABLE INTEGRAL UPPER PORTION

(75) Inventor: John David Norcom, Middletown, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 2227 days.

(21) Appl. No.: 11/068,092

(22) Filed: Feb. 28, 2005

(65) Prior Publication Data

US 2006/0193541 A1 Aug. 31, 2006

(51) Int. Cl.
*B65D 88/00* (2006.01)
*B65D 6/08* (2006.01)
*B65D 30/08* (2006.01)

(52) U.S. Cl. ..... 220/1.6; 220/495.08; 383/107

(58) Field of Classification Search ..... 220/1.6, 220/495.08, 62.21, 6; 383/107
See application file for complete search history.

(56) References Cited

U.S. PATENT DOCUMENTS

| | | | | |
|---|---|---|---|---|
| 2,556,321 | A * | 6/1951 | Denton | 383/33 |
| 2,794,473 | A | 6/1957 | Williams | |
| 4,126,265 | A | 11/1978 | Holmes | |
| 4,186,786 | A | 2/1980 | Kirkpatrick | |
| 4,285,105 | A | 8/1981 | Kirkpatrick | |
| 4,363,345 | A | 12/1982 | Scheibner | |
| 4,561,109 | A | 12/1985 | Herrington | |
| 4,622,693 | A | 11/1986 | Mykleby | |
| 4,779,998 | A | 10/1988 | Wischusen | |
| 4,785,957 | A | 11/1988 | Beck et al. | |
| 4,898,301 | A | 2/1990 | Schick | |
| 5,028,147 | A | 7/1991 | Graham | |
| 5,178,469 | A | 1/1993 | Collinson | |
| 5,572,851 | A | 11/1996 | Weder | |
| 5,598,952 | A | 2/1997 | Daansen | |
| 5,662,758 | A | 9/1997 | Hamilton et al. | |
| 5,799,818 | A | 9/1998 | Ringer | |
| 5,804,265 | A | 9/1998 | Saad et al. | |
| 5,806,408 | A | 9/1998 | DeBacker et al. | |
| 5,820,268 | A * | 10/1998 | Becker et al. | 383/99 |
| 5,851,070 | A | 12/1998 | Dobreski et al. | |

(Continued)

FOREIGN PATENT DOCUMENTS

DE 8500532 U1 4/1985

(Continued)

OTHER PUBLICATIONS

International Search Report mailed Jul. 4, 2006 (6 pages).

*Primary Examiner* — Bryon Gehman
*Assistant Examiner* — Shawn Braden
(74) *Attorney, Agent, or Firm* — Brent M. Peebles; David K. Mattheis

(57) ABSTRACT

A container including a support structure defined by a side wall portion and a bottom wall portion. An upper portion is integrally attached to the support structure, where the upper portion is formed of a flexible material defining opposing portions. The flexible material has a lower stiffness than a stiffness of the side wall portion, and the opposing portions are movable between a closed position located in engagement with each other and an open position where the opposing portions are separated from each other defining an opening to an interior area of the container. A frangible portion is provided on the upper portion forming a predefined separation line for separating at least a portion of the upper portion from the support structure.

20 Claims, 7 Drawing Sheets

U.S. PATENT DOCUMENTS

| | | | | |
|---|---|---|---|---|
| 5,897,012 | A | 4/1999 | Sortwell | |
| 6,080,096 | A * | 6/2000 | Becker et al. | 493/311 |
| 6,116,501 | A | 9/2000 | Hupp | |
| 6,164,821 | A | 12/2000 | Randall | |
| 6,325,239 | B2 | 12/2001 | Randall et al. | |
| 6,489,022 | B1 | 12/2002 | Hamilton et al. | |
| 6,708,835 | B1 * | 3/2004 | Mathis | 220/4.03 |
| 6,840,401 | B2 * | 1/2005 | Amundson | 221/56 |
| 2002/0162767 | A1 | 11/2002 | Ohtsubo | |
| 2004/0004111 | A1 | 1/2004 | Cardinale | |
| 2006/0191929 | A1 | 8/2006 | Berg | |
| 2006/0191985 | A1 | 8/2006 | Norcom | |

FOREIGN PATENT DOCUMENTS

| | | | |
|---|---|---|---|
| DE | 10050727 | A1 | 4/2002 |
| DE | 20200417 | U1 | 7/2002 |
| FR | 2116269 | A | 7/1972 |

* cited by examiner

CONTAINER INCLUDING REMOVABLE INTEGRAL UPPER PORTION

FIELD OF THE INVENTION

The present invention relates to storage containers, and more particularly, to such containers wherein the container includes a removable portion facilitating access to the interior of the container.

BACKGROUND OF THE INVENTION

The use of storage bags for containing and protecting items, including preservation of perishable materials such as food items, is generally known in the art. Such storage bags include bags formed of opposing sheets of film material joined together along peripheral edges to form a semi-enclosed container having three sealed or folded edges and one open edge. The open edge is typically provided with a closure, such as a reclosable or reusable seal formed integrally, as may be provided by an integrally formed interlocking seal. Such storage bags may be readily opened and resealed and may be formed of lower cost materials making disposability of such bags practical.

With regard to rigid or semi-rigid containers, it is well recognized that such containers have also realized a fair degree of commercial success in providing a means for storing a wide variety of contents. Such containers typically have an opening which maintains an open condition for filling and/or removal of contents and which may be resealably closed by a removable top. Such containers also are frequently provided with flat bottoms and tops to provide stackability. However, such containers typically use more material than bags such that disposability may be limited. At the same time, the useful life of such containers may be limited by damage, soiling, or other degradation naturally occurring in use.

Accordingly, it would be desirable to provide a container combining desirable qualities of both flexible bags and rigid or semi-rigid storage containers.

SUMMARY OF THE INVENTION

In accordance with one aspect of the invention, a container is provided comprising a structure comprising a side wall portion and a bottom wall portion. An upper portion comprising a sheet of material is integrally attached to the structure, the upper portion defining a closable opening for the container. A frangible portion is defined between the upper portion and the structure forming a predefined portion for separating at least a portion of the sheet of material from the structure.

In accordance with another aspect of the invention, a container is provided comprising a structure comprising a side wall portion and a bottom wall portion. An upper portion comprising a sheet of material is integrally attached to the structure, the upper portion defining a closable opening for the container. A frangible portion is located along the upper portion extending from the opening toward the structure and forming a predefined portion for separating adjacent portions of the sheet of material.

In accordance with a further aspect of the invention, a container is provided comprising a structure comprising a side wall portion and a bottom wall portion, the side wall portion including an edge distal from the bottom wall portion. An upper portion comprising a sheet of material defining opposing panels is integrally attached to the structure, the upper portion defining a closable opening for the container. A frangible portion is defined between the upper portion and the structure forming a predefined portion for separating at least a portion of the sheet of material from the structure.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
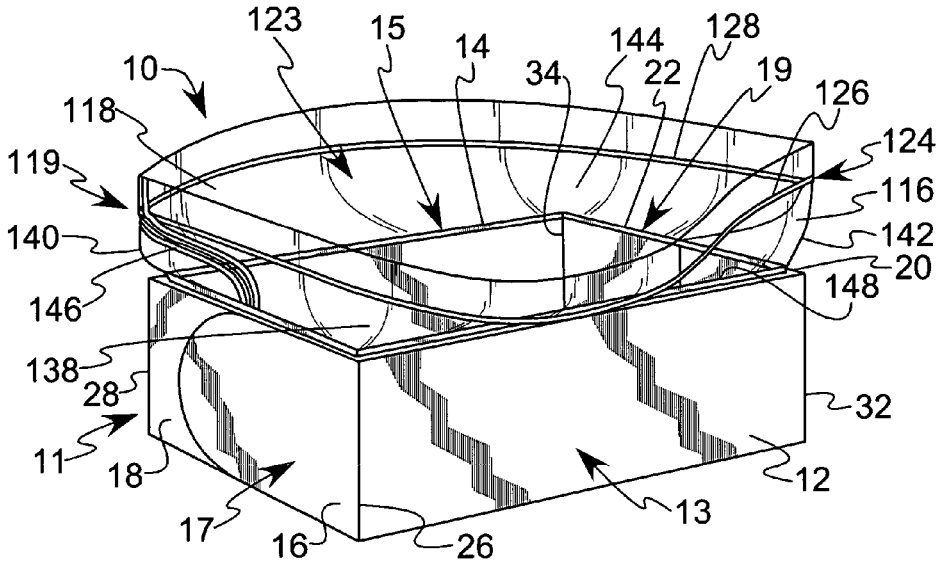
FIG. 1 is a perspective view of a container illustrating the present invention in an erected configuration.
Figure 2:
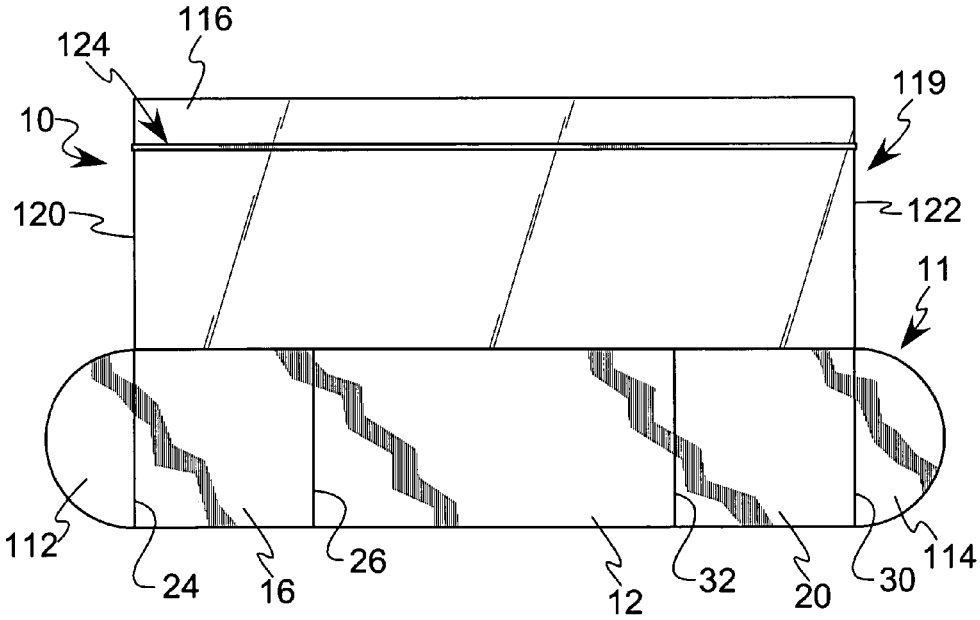
FIG. 2 is a side elevation view of the container illustrating the present invention in a collapsed configuration.
Figure 3:
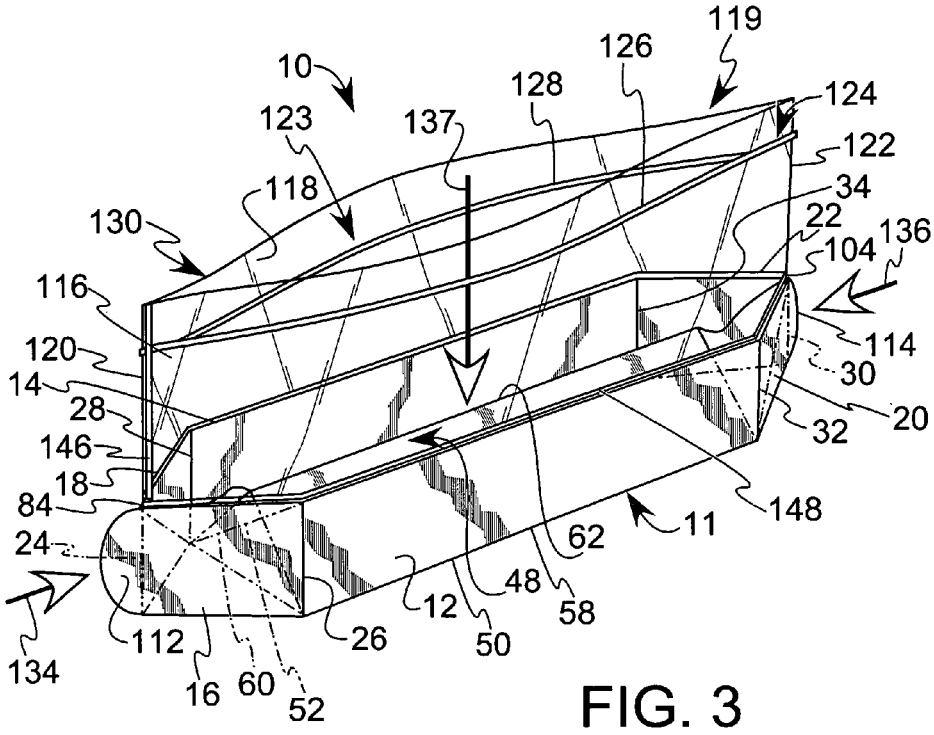
FIG. 3 is a perspective view of the container illustrating the present invention in a partially erected configuration.

Referring to FIGS. 1-3, a container 10 in accordance with the teachings of the present invention is shown. The container 10 generally includes a support structure 11 movable between a configuration defining a flexi-resilient structure and a configuration defining a rigid or semi-rigid structure. The support structure 11 comprises opposing first and second longitudinal side walls 12, 14 defining first and second container sides 13, 15; a first pair of end side walls comprising first and second end side walls 16, 18 defining a third container side 17; and a second pair of end side walls comprising first and second end side walls 20, 22 defining a fourth container side 19. The first pair of end side walls 16, 18 are connected to each other at a medial wall hinge 24, and are also connected to a respective longitudinal side wall 12, 14 at wall hinges 26, 28. Similarly, the second pair of end side walls 20, 22 are connected to each other at a medial wall hinge 30, and are also connected to a respective longitudinal side wall 12, 14 at wall hinges 32, 34.

Figure 4:
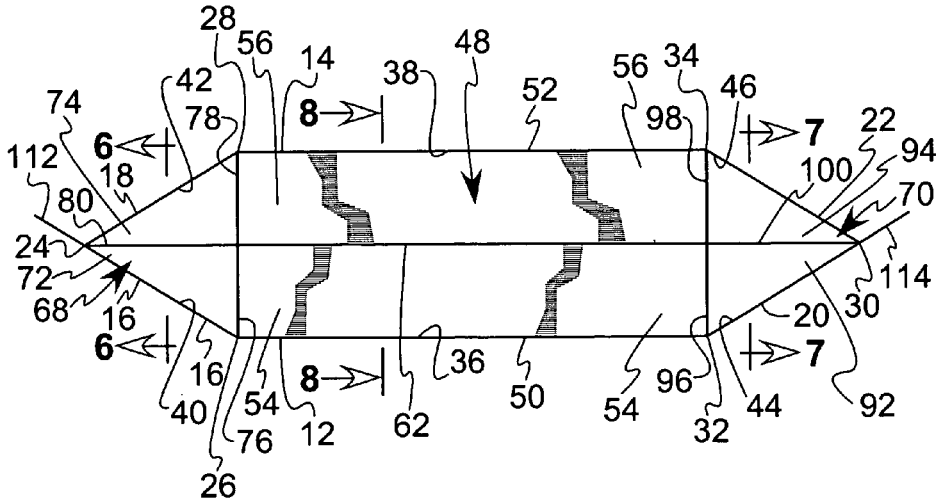
FIG. 4 is a top plan view of the container of FIG. 3 without the side panels.

Referring to FIGS. 3 and 4, the first pair of end side walls 16, 18 may be articulated relative to each other and relative to the longitudinal side walls 12, 14 at the wall hinges 24, 26, 28, respectively, and the second pair of end side walls 20, 22 may be articulated relative to each other and relative to the longitudinal side walls 12, 14 at the wall hinges 30, 32, 34, respectively. The side walls 12, 14, 16, 18, 20, 22 are articulable to move from a generally flat collapsed configuration, where the support structure 11 comprises a flexi-resilient structure, to an erected three-dimensional configuration, where the support structure 11 comprises a substantially rigid or semi-rigid structure. In the flat collapsed configuration of the container 10, inner faces 36, 38 of the longitudinal side walls 12, 14 are located facing toward each other, inner faces 40, 42 of the first pair of end side walls 16, 18 are located facing toward each other, and inner faces 44, 46 of the second pair of end side walls 20, 22 are located facing toward each other (see FIG. 4). In the erected configuration of the container 10, the inner faces 36, 38 of the longitudinal side walls 12, 14 are located in spaced relation to each other, the first pair of end side walls 16, 18 are aligned substantially parallel to each other and substantially perpendicular to the longitudinal side walls 12, 14, and the second pair of end side walls 20, 22 are aligned substantially parallel to each other and substantially perpendicular to the longitudinal side walls 12, 14, to define a generally rectangular area circumscribed by the side walls 12, 14, 16, 18, 20, 22 (see FIG. 1).

Figure 8:
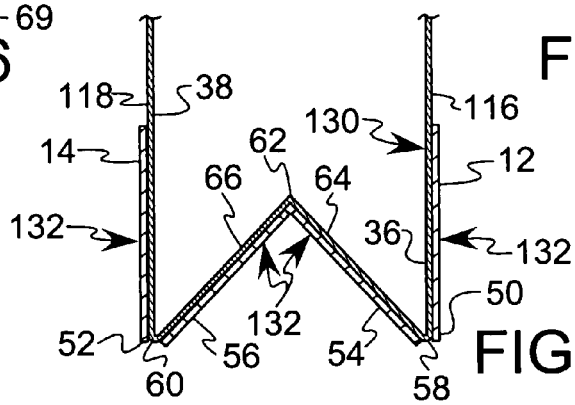
FIG. 8 is a cross-sectional view taken along line 8-8 in FIG. 4.

The container 10 further includes a bottom wall 48 extending between edges 50, 52 of the longitudinal side walls 12, 14. In the illustrated embodiment, the bottom wall 48 may be formed with first and second bottom sections 54, 56 connected to the edges 50, 52 at edge hinges 58, 60 (see also FIG. 8) and connected to each other at a medial bottom hinge 62 extending parallel to the edge hinges 58, 60. A width dimension of each of the bottom sections 54, 56, between the medial bottom hinge 62 and the respective edge hinges 58, 60, is preferably substantially equal to the width of the end walls 16, 18, 20, 22, as measured between the medial wall hinges 24, 30 and the respective wall hinges 26, 30 and 32, 34. The medial bottom hinge 62 generally lies in an imaginary plane I (FIG. 5) defined by the medial wall hinges 24 and 30 in both the collapsed configuration and in the erected configuration. In the collapsed configuration, the first and second bottom sections 54, 56 are located between the longitudinal side walls 12, 14, where a surface 64 (FIG. 8) of the first bottom section 54 is located facing toward the inner face 36 of the longitudinal side wall 12, and a surface 66 of the second bottom section 56 is located facing toward the inner face 38 of the longitudinal side wall 14. In the erected configuration, the first and second bottom sections 54, 56 may be aligned generally parallel to each other and generally perpendicular to the longitudinal side walls 12, 14. It should be noted that although preferred dimensional relationships between the components of the container 10 are described herein, those skilled in the art will recognize that the relative dimensions of the components, as well as the degree of displacement of the components relative to each other, the number of components that comprise a wall, the consistency or inconsistency of the dimensions of the components with each other, may vary and still remain functional within the scope of the invention.

Figure 4A:
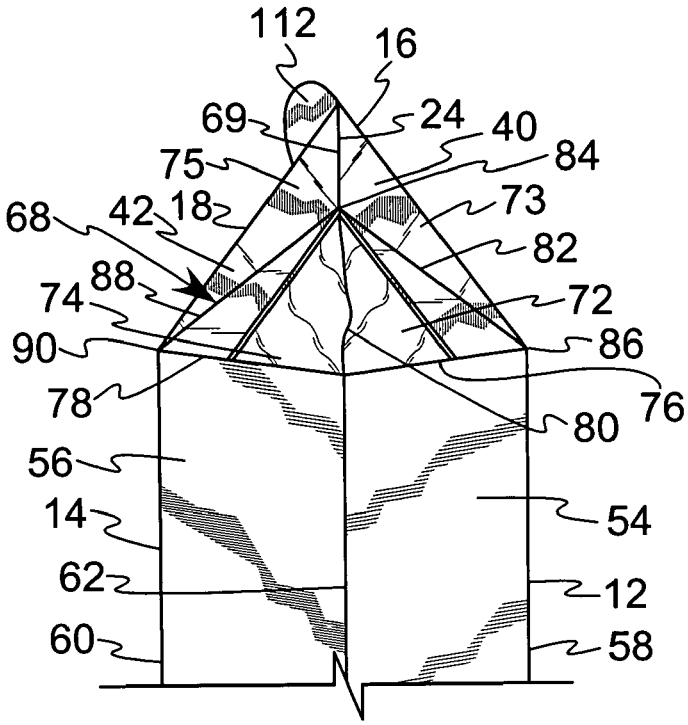
FIG. 4A is a bottom perspective view of an end of the container comprising a first pair of end panels of the container.
Figure 4B:
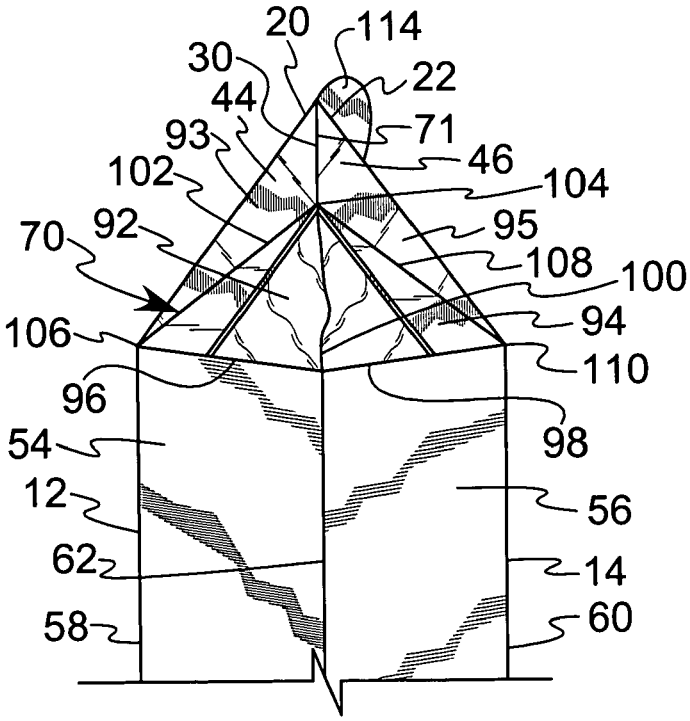
FIG. 4B is a bottom perspective view of an end of the container comprising a second pair of end panels of the container.
Figure 5:
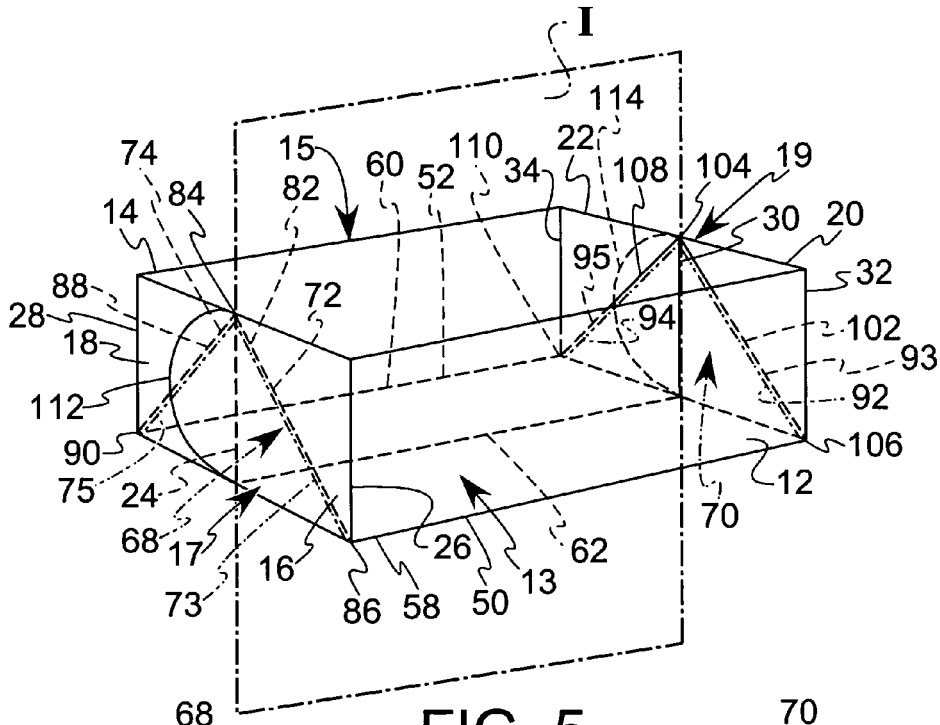
FIG. 5 is a perspective view similar to FIG. 1 without the side panels.
Figure 6:
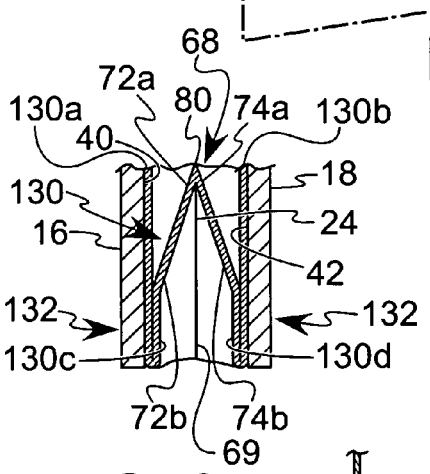
FIG. 6 is a cross-sectional view taken along line 6-6 in FIG. 4.
Figure 7:
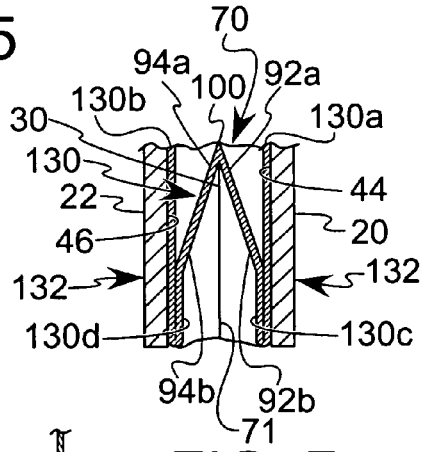
FIG. 7 is a cross-sectional view taken along line 7-7 in FIG. 4.

As seen in FIGS. 3-7, a first gusset structure 68 extends from the bottom wall 48 to the first pair of end side walls 16, 18, and a second gusset structure 70 extends from the bottom wall 48 to the second pair of end side walls 20, 22. In one construction of the container 10, inner surfaces of the side walls 12, 14, 16, 18, 20, 22, the bottom wall 48 and the first and second gusset structures 68, 70 comprise a substantially continuous sheet of flexible material 130. The flexible material 130 comprises a pair of opposing generally planar portions 130*a* and 130*b* (FIGS. 6 and 7). The portion 130*a* of the flexible material 130 extends along side walls 12, 16, 20, and portion 130*b* of the flexible material 130 extends along side walls 14, 18, 22. A further portion 130*c* of the flexible material 130 extends from edges of the side walls 12, 16, 20 and extends adjacent the portion 130*a*, and a further portion 130*d* of the flexible material 130 extends from edges of the side walls 14, 18, 22 and extends adjacent the portion 130*b*. The further extending portions 130*c* and 130*d* are connected to each other along opposing edges 69, 71 (FIGS. 4A, 4B, 6 and 7) which edges 69, 71 are attached at the medial wall hinges 24, 30, respectively. In addition, the portions 130*c* and 130*d* are joined along first and second gusset hinges 80, 100 (see FIGS. 4, 4A, 4B, 6 and 7). The first gusset hinge 80 is defined on the first gusset structure 68 extending from a location adjacent an end 84 of the medial wall hinge 24 to the medial bottom hinge 62, and the second gusset hinge 100 is defined on the second gusset structure 70 extending from a location adjacent an end 104 of the medial wall hinge 30 to the medial bottom hinge 62.

Referring to FIGS. 3, 4 and 4A, the first gusset structure 68 comprises first and second movable gusset portions 72, 74, and first and second substantially stationary gusset portions 73, 75. The first gusset portions 72, 73 are separated along a fold line 82 at the inner face 40. Preferably, the fold line 82 extends from a location adjacent the end 84 of the medial wall hinge 24 to an intersection 86 of the edge hinge 58 with the end side wall 16. The second gusset portions 74, 75 are separated along a fold line 88 at the inner face 42. Preferably, the fold line 88 extends from a location adjacent the end 84 of the medial wall hinge 24 to an intersection 90 of the edge hinge 60 with the end side wall 18. The movable gusset portions 72, 74 extend from respective hinges 76, 78 at first ends of the bottom sections 54, 56 to the respective fold lines 82, 88. The movable gusset portions 72, 74 are connected for articulation relative to each other along the first gusset hinge 80.

Similarly, referring to FIGS. 3, 4 and 4B, the second gusset structure 70 comprises first and second movable gusset portions 92, 94, and first and second substantially stationary gusset portions 93, 95. The first gusset portions 92, 93 are separated along a fold line 102 at the inner face 44. Preferably, the fold line 102 extends from a location adjacent the end 104 of the medial wall hinge 30 to an intersection 106 of the edge hinge 58 with the end side wall 20. The second gusset portions 94, 95 are separated along a fold line 108 at the inner face 46. Preferably, the fold line 108 extends from a location adjacent the end 104 of the medial wall hinge 30 to an intersection 110 of the edge hinge 60 with the end side wall 22. The movable gusset portions 92, 94 extend from respective hinges 96, 98 at second ends of the bottom sections 54, 56 to the respective hinges 102, 108. The movable portions 92, 94 are connected for articulation relative to each other along the second gusset hinge 100.

The fold lines 82, 88, 102, 108 are substantially stationary due to each of the fold lines 82, 88, 102, 108 forming a side of a triangle defined by a respective substantially stationary gusset portion 73, 75, 93, 95, the two remaining sides of which are attached to a respective side wall 16, 18, 20, 22. It should be noted that the fold lines 82, 88, 102, 108 may alternatively or additionally be defined by a joint or attachment to the material of the adjacent side wall 16, 18, 20, 22.

Referring to FIG. 6, the first and second movable gusset portions 72 and 74 of the first gusset structure 68 each comprise respective first and second surfaces 72*a*, 72*b* and 74*a*, 74*b*. When the container 10 is in its collapsed configuration, the first gusset structure 68 is located between the end side walls 16, 18 and folded about the first gusset hinge 80 with the first and second gusset portions 72, 74 extending generally parallel to the bottom sections 54, 56 and with the first surfaces 72*a*, 74*a* facing toward respective inner faces 40, 42 of the end side walls 16, 18. Referring to FIG. 5, when the container 10 is in its erected configuration, the movable gusset portions 72, 74 of the first gusset structure 68 are folded about fold lines 82 and 88 with the folded gusset structure being located generally parallel to and adjacent the end side walls 16, 18 with the folded first and second movable gusset portions 72, 74 extending generally perpendicular to the bottom sections 54, 56 and with the second surfaces 72*b*, 74*b* facing toward respective inner faces 40, 42 of the end side walls 16, 18.

Referring to FIG. 7, the first and second movable gusset portions 92 and 94 of the second gusset structure 70 each comprise respective first and second surfaces 92*a*, 92*b* and 94*a*, 94*b*. When the container 10 is in its collapsed configuration, the second gusset structure 70 is located between the end side walls 20, 22 and folded about the second gusset hinge 100 with the first and second gusset portions 92, 94 extending generally parallel to the bottom sections 54, 56 and with the first surfaces 92*a*, 94*a* facing toward respective inner faces 44, 46 of the end side walls 20, 22. Referring to FIG. 5, when the container 10 is in its erected configuration, the movable gusset portions 92, 94 of the second gusset structure 70 are folded about fold lines 102 and 108 with the folded gusset structure being located generally parallel to and adjacent the end side walls 20, 22 with the folded first and second movable gusset portions 92, 94 extending perpendicular to the bottom sections 54, 56 and with the second surfaces 92*b*, 94*b* facing toward respective inner faces 44, 46 of the end side walls 20, 22.

The first and second gusset hinges 80, 100 each define a length that is preferably substantially equal to the width of the bottom sections 54, 56. However, as noted above, those skilled in the art will recognize that the relative dimensions of the components may be varied within the scope of the invention and still provide a functional container. As the container 10 moves from the collapsed configuration to the erected configuration, the first and second gusset hinges 80, 100 move from an orientation substantially collinear with the medial bottom hinge 62 toward a substantially perpendicular orientation relative to the medial bottom hinge 62 and substantially parallel and adjacent to the medial wall hinges 24, 30, respectively. The first and second gusset structures 68, 70 provide a supporting structure between the first and second pairs of end side walls 16, 18 and 20, 22 and the bottom wall 48. The first and second gusset structures 68, 70 provide a structure that may resist pivoting movement of the bottom sections 54, 56 past a predetermined location. By way of non-limiting example, the first and second gusset structures 68, 70 may resist pivoting movement of the bottom sections 54, 56 past a plane defined by edges of the side walls 12, 14, 16, 18, 20, 22 when the container is in the erected configuration.

In one embodiment, the gusset structures 68, 70 are formed of a flexible material, for example a flexible film material as described further below, for constructing the container 10. A flexible gusset structure material may readily articulate or bend, i.e., may buckle or partially double over, to accommodate variations in distance between the ends 84, 104 of the medial wall hinges 24, 30 and the ends of the medial bottom hinge 62 during movement of the container 10 between the collapsed and the erected configurations. The gusset structures 68, 70 may define a continuous flexible membrane between the container sides 13, 15, 17, 19 and the bottom wall 48 for facilitating retention of contents located in the container 10.

The container 10 may be provided with structure for maintaining the container 10 in its erected configuration. In the illustrated embodiment, the end side walls 16 and 20 are each provided with a respective extension 112, 114 for extending in overlapping relation to the adjacent end side walls 18 and 22, see FIG. 2. The extensions 112, 114 may be attached or adhered to the adjacent end side walls 18, 22 such that pivoting movement between the first and second pairs of end side walls 16, 18 and 20, 22 is substantially prevented to maintain the container 10 in its erected configuration. The extensions 112, 114 may be provided with an adhesive attachment means to adhere to the adjacent end side walls 18, 22. The adhesive attachment means may include without limitation, pressure sensitive adhesives, with or without a peel-off covering strip, and cohesives, i.e., adhesives which adhere only to itself. Alternatively or in addition, mechanical means may be provided for attaching the extensions 112, 114 to the adjacent end side walls 18, 22 including, without limitation, tabs in slots, straps, clips, adhesive strips, clamping elements, and snap or otherwise interfitting parts such as interengaging dimple and recess elements.

Alternatively, or in addition, the structure for maintaining the container 10 in an erected configuration may comprise a locking feature including an extension or extensions (not shown) provided to the bottom sections 54, 56, such as an extension (not shown) extending past one or more of the hinge locations 76, 78, 96, 98 on the bottom sections. Such an extension may extend past a respective hinge location 76, 78, 96, 98, but would preferably not be sealed, adhered or otherwise connected to the flexible material 130 of the hinge structures 68, 70. The extension or extensions (not shown) of the bottom sections 54, 56 may be preferably dimensioned such that the extension(s) extend longitudinally past and include a surface engaging against one or more of the respective end walls 16, 18, 20, 22. In the erected configuration, the engagement of the extension(s) of the bottom sections 54, 56 against edges of the end walls 16, 18, 20, 22 may substantially prevent pivoting movement of the bottom sections 54, 56 toward the collapsed configuration and thereby lock the container in the erected configuration. The locking mechanism incorporating the extension(s) of the bottom sections 54, 56 may be provided in place of the locking mechanism utilizing the extensions 112, 114.

It should be noted that the structure and operation of the present invention is not limited to the four-sided container described herein and the principles of the present invention may be applicable to five-or-more-sided polygon container configurations. By way of non-limiting example of such variations, the container of the present invention may comprise a three-sided container in which two longitudinal side walls are joined at one end by a wall hinge and are connected to a pair of end side walls at an opposite end, where movement of the pair of end side walls may be effected in a manner similar to the articulated movement of the pairs of end side walls of the above-described embodiment to move the three-sided container from a generally flat configuration to an erected configuration.

In accordance with a further aspect of the invention, the container 10 includes two generally planar opposing side panels 116, 118 extending from the side walls 12, 14, 16, 18, 20, 22 to define a flexible bag-like upper portion 119 for the container 10. The side panel 116 extends from the side walls 12, 16 and 20, and the side panel 118 extends from the side walls 14, 18 and 22. The side panels 116, 118 are attached together along elongated edge seams 120, 122 where the edge seams 120, 122 may be formed by ultrasonic welding, heat sealing, an adhesive or other conventional attachment means, joined in a butt joint, lap seam, a fin seal or other configuration. The edge seams 120, 122 may be located substantially collinear with the medial wall hinges 24, 30.

An end of the side panels 116, 118 distal from the support structure 11 defines an open mouth 123 for the container 10 for passage of contents into and/or out of the container 10. An optional, reusable closure 124 is shown located at the mouth 123 of the container and is illustrated as complementary mating elements 126, 128 attached to the interior of the side panels 116, 118 for reclosably sealing the mouth 123 of the container 10. For example, the reusable closure 124 may comprise an interlocking seal type closure, and which may or may not include a slider for manipulating opening and closing of the container 10. The present invention is not limited to the illustrated reusable closure, and non-limiting examples of reusable closures which may be employed, and information on their manufacture, are described in U.S. Pat. Nos. 4,186,786; 4,285,105; 4,363,345; 4,561,109; 5,804,265 and 5,851,070. Additional closure structures may be incorporated for closing the mouth 123 of the container 10 including, without limitation, mechanical fasteners such as hook-and-loop fasteners, snap closures, grips, clips, and clamps, flap closures, tie flaps, drawstring closures, twist-tie closures, and adhesion closures such as pressure sensitive adhesive tapes or strips, mating cohesives, epoxy-resin reactive adhesives, and pressure sensitive adhesive embedded activated films. Non-limiting examples of pressure sensitive adhesive embedded activated films which may be used, and information on their manufacture may be found in U.S. Pat. Nos. 5,662,758 and 6,489,022. Although reusable closures have been mentioned as a preferred closure, a more permanent closure may be preferred in certain applications of the invention. Full or partial closures, or absence of closures, other than those specifically mentioned herein may also be provided within the scope of the described invention.

The illustrated embodiment of the container 10 is constructed from a sheet or sheets of the flexible material 130, where the term "flexible" is utilized to refer to materials which are capable of being flexed or bent, especially repeatedly, such that they are pliant and yieldable in response to externally applied forces. Accordingly, "flexible" is substantially opposite in meaning to the terms inflexible, rigid, or unyielding. Materials and structures which are flexible, therefore, may be altered in shape and structure to accommodate external forces and to conform to the shape of objects brought into contact with them without losing their integrity. The sheet material 130 for forming the container 10 may comprise a flexible film material including a polymeric film, such as polypropylene or comparable material, where a polypropylene material may be provided in a thickness of from 0.5 to 5 mils, for example.

The sheet or sheets of flexible material 130 forming the container 10 may form the side walls 12, 14, 16, 18, 20, 22, the bottom wall 48, the first and second gusset structures 68, 70, and the side panels 116, 118 as a continuous flexible containment material. Alternatively, the flexible material 130 can comprise a bag-like or tube-like structure. Further, the side walls 12, 14, 16, 18, 20, 22 and bottom sections 54, 56 define surfaces of the container 10 capable of pivoting relative to each other at respective hinges where the hinges may be formed by the flexible material 130. In the illustrated embodiment of the container 10, each of the side walls 12, 14, 16, 18, 20, 22 and bottom sections 54, 56 are defined by a layered structure comprising the flexible material 130 and a panel of structural material 132 that is attached to the exterior surface of the flexible material 130 as shown, for example, in FIGS. 6-8. In a non-limiting example of the invention, the panel of structural material 132 may comprise a material having a flexural modulus in the range of between 170,000 and 250,000 psi and a thickness of between 0.01 and 0.50 inches, as compared to the flexible material 130 which has a flexural modulus of between 170,000 and 250,000 psi and a thickness of between 0.0005 and 0.01 inches. The structural material 132 is preferably stiffer than the flexible material 130 and is preferably capable of resiliently flexing from and returning to a predetermined initial shape, such as a generally planar shape. As used herein, the term "flexural modulus" means the flexural modulus as determined according to ASTM Test Method D 790. In one embodiment the structural material 132 may preferably comprise a polypropylene material. However, additional or other materials may be used for the structural material 132 including, without limitation, any known polymeric material including extruded corrugate polymeric materials, carded fibrous materials, and fine fluted corrugates. Those skilled in the art will recognize that the particular stiffness for either the flexible material 130 or the structural material 132 may be adjusted in accordance with a desired end use or application for the container 10.

The structural material 132 may be attached to the flexible material 130 by means of a mechanical connection forming a molecular level bond between the structural material 132 and the flexible material 130, such as by ultrasonic welding, or a thermal bond, e.g., heat sealing. Alternatively, the structural material 132 and flexible material 130 may be joined by adhesives or cohesives including without limitation contact adhesives, or by mechanical connections such as a snap fit, clips, rubber bands, mechanical fasteners, grips, staples, clamps, and/or an interference fit connection between the two materials, i.e., a tolerance fit such as by locating the structural material 132 in a tight fit within the flexible material 130, or a mechanical punching of the material together. Such attachment may be continuous or discontinuous as in, for example, a series of two or more points of attachment.

It should be noted that structural material 132 comprising the bottom sections 54, 56 may optionally be unattached to the flexible material 130. In such a case, the structural material 132 of the bottom sections 54, 56 may be attached to other structure, for example, one or more of the side walls, 12, 14, 16 18, 20, 22. Further, although the illustrated construction locates the structural material 132 on the exterior surface of the flexible material 130, some or all portions of the structural material 132 may be located on the inside surface of the flexible material 130. Optionally, the bottom sections 54, 56 may be formed without the structural material 132, such that the bottom wall 48 may comprise a relatively flexible area defined by the flexible material 130.

Alternatively, the side walls 12, 14, 16 18, 20, 22 and/or bottom sections 54, 56 may be formed with less than the full area of the side walls 12, 14, 16 18, 20, 22 and/or bottom sections 54, 56 covered with the structural material 132. For example, the side walls 12, 14, 16 18, 20, 22 and/or bottom sections 54, 56 may include frame members (not shown) located so as to maintain the structural integrity or shape of the side walls 12, 14, 16 18, 20, 22 and/or bottom sections 54, 56 during movement between the collapsed configuration and the erected configuration and/or during use of the container 10. It should be understood that any construction capable of providing a stiffness to the side walls 12, 14, 16 18, 20, 22 and/or the bottom sections 54, 56 greater than the stiffness of the flexible material 130 may be used, whether solid or perforated sheets or frames or other structural elements are employed, which construction need not necessarily include providing separate or attached rigidifying structure to the side walls 12, 14, 16 18, 20, 22 and/or bottom sections 54, 56. For example, the side walls 12, 14, 16 18, 20, 22 and/or bottom sections 54, 56 may be formed of the same sheet of material comprising the side panels 116, 118, but formed with a different material characteristic to affect the stiffness of the material, such as may be provided by a different material caliper or by increased cross-linking or crystallization of the material in the side walls 12, 14, 16 18, 20, 22 and/or bottom sections 54, 56, or the material stiffness may be altered or controlled by mechanical means such as by forming folds, creases or corrugations in the material.

Although the flexible material 130 has been described as flexible polypropylene film material, other materials exhibiting flexible characteristics may be incorporated as the flexible material 130 including without limitation, substantially impermeable polymeric materials, cellulose materials, aluminum foil, coated (waxed, etc.) and uncoated paper, coated nonwovens etc., and substantially permeable materials such as scrims, meshes, wovens, nonwovens, open or closed cell foams, or perforated or porous films, whether predominantly two-dimensional in nature or formed into three-dimensional structures. Such materials may comprise a single composition or layer or may be a composite or laminate structure of multiple materials, including a substrate material utilized as a carrier for a substance. Further, those skilled in the art will recognize that any material that provides the desired stiffness characteristics for the flexible material 130 may be incorporated within the scope of the present invention.

The flexible material 130 is not limited to constructions formed from sheet materials, and the flexible material portion of the container 10 may be constructed in any known and suitable fashion such as those known in the art for making bags or storage containers in commercially available form. Heat or adhesive sealing technologies may be utilized to join various components or elements of the flexible material 130 to themselves or to each other. In addition, the flexible material portion of the container 10 may be thermoformed, blown, or otherwise formed or molded as an alternative to reliance upon folding and bonding techniques to construct the flexible material portion from a web or sheet of material.

The materials selected for either or both the flexible material 130 and the structural material 132 may exhibit any degree of transparency, translucency and/or opacity, such as may be selected to provide a desired degree of visual identification of contents and may include colored transparent, translucent and/or opaque materials. The degree of transparency, translucency and/or opacity may additionally be selected to facilitate writing and/or reading textual messages, i.e., container contents and/or directions, on the container 10.

Also included among materials acceptable for forming the flexible material 130 and the structural material 132 are microwaveable materials. Further, the flexible material 130 and the structural material 132 may comprise materials and constructs or structures providing insulative properties for limiting flow of heat between exterior and interior surfaces of the container 10, such as may be provided to the bottom wall 48 or other contacted surfaces to limit heat transfer to a user's hand or a supporting surface. Such materials may include those materials which generally have a lower heat conductivity, lower heat/cold capacity, less mass and/or material structures influencing the thermal conductivity and/or thermal capacity, such as materials including void spaces for either partially or fully enveloping or enclosing a fluid, such as air, within the material. Examples of materials for providing desirable thermal properties to the container 10 include, without limitation, open or closed cell foamed materials, small air entrapping materials, e.g., fibers, down, spaced particles, etc., dispersed through, on or between the flexible material 130 and/or structural material 132, low mass portions defined in the flexible material 130 and/or structural material 132, e.g., thinned portions of the flexible material 130 and/or structural material 132, and/or provision of a low heat transference insulative layer or coating between the flexible material 130 and structural material 132. Such materials may be in the form of a corrugated paper or polymer material structure formed of one or two or more layers having offset areas, such as may be formed by thermoforming, embossing, folding, etc. For example, a multi-layered structure formed of two layers, at least one of which includes areas offset from the plane of the other layer, or a single layer material where selected areas of the material are offset from other areas of the material to provide a volume of insulative air between exterior and interior surfaces of the container. Alternatively, a thermal barrier may be formed by two or more layers of flexible polymeric material selectively sealed or bonded together to produce areas of entrapped air.

In the collapsed configuration of the container 10, as illustrated in FIG. 2, the container 10 is substantially flat with the side walls 12, 16, 20 located in generally collinear relationship to each other, and with the remaining side walls 14, 18, 22 located in generally collinear relationship to each other and positioned parallel and adjacent to the side walls 12, 16, 20, respectively. The bottom sections 54, 56 are located adjacent each other and between the opposing side walls 12 and 14, and the first and second gusset structures 68, 70 are located between the opposing pairs of end side walls 16, 18 and 20, 22, respectively. In addition, the opposing side panels 116, 118 lie generally parallel and adjacent to each other, and may or may not be folded over, such as at the junction with the side walls 12, 14, 16, 18, 20, 22, i.e., at the junction of the bag-like portion 119 with the support structure 11, to form a compact relatively flat collapsed configuration of the container 10. It should be noted that the support structure 11 comprises a flexi-resilient structure prior to completion of the process of erecting the container, where the side walls 12, 14, 16, 18, 20, 22 and bottom sections 54, 56 are generally articulable and movable relative to each other.

In accordance with one method of erecting the container 10, forces may be applied to generally oppositely located portions of the container 10. The resultant of the applied forces may be directed in generally opposite directions extending through the container 10. By way of a non-limiting preferred example, forces may be applied to the container 10 adjacent the medial wall hinges 24, 30, as indicated by the arrows 134, 136 in FIG. 3, to push the medial wall hinges 24, 30 inwardly toward each other. Substantially simultaneously with the inward movement of the medial wall hinges 24, 30, the pairs of adjacent end side walls 16, 18 and 20, 22 pivot relative to each other toward a generally coplanar orientation while also pivoting generally inwardly toward the respective adjacent side walls 12, 14, such that the side walls 12, 14, 16, 18, 20, 22 define a substantially rigid or semi-rigid base structure for the container. Substantially simultaneously with the pivoting movement of the side walls 12, 14, 16, 18, 20, 22, the bottom sections 54, 56 pivot away from the respective side walls 12, 14, such that the medial bottom hinge 62 moves in a direction generally indicated by arrow 137 in FIG. 3, to form the bottom wall 48 of the erected container 10. In addition, the gusset structures 68, 70 pivot in response to the movement of the bottom sections 54, 56 and relative pivoting movement of the pairs of end side walls 16, 18 and 20, 22, where the gusset portions 72, 74, 92, 94 each generally pivot about the respective fold lines 82, 88, 102, 108 as the gusset hinges 80, 100 pivot from an orientation substantially parallel to the medial bottom hinge 62 to an orientation substantially perpendicular to the medial bottom hinge 62.

Alternative forces may be applied to cause the container 10 to transform from the collapsed configuration to the erected configuration including, without limitation, application of a force or forces on one or more of the end side walls 16, 18, 20, 22 to cause one or more end side wall 16, 18, 20, 22 to pivot relative an adjacent longitudinal side wall 12, 14. As a further alternative, forces may be applied on the longitudinal side walls 12, 14 to cause the longitudinal side walls to move outwardly away from each other. In a further alternative, a force may be applied to one or more locations on the bottom wall 48 to cause the bottom wall 48 or the sections 54, 56 of the bottom wall 48 pivot relative to the respective adjacent side wall 12, 14. It should be understood that application of a force to move one or more walls of the container 10 relative to at least one other wall, such as an adjacent wall, may generally cause the remaining walls to move toward the erected configuration.

Application of a force or forces to move the container 10 between collapsed and erected configurations may be facilitated by additional structure associated with one or more walls 12, 14, 16, 18, 20, 22, 48 of the container 10, such as structure which may facilitate forming a gripping surface and/or applying a leveraged force thereto. Such additional structure may include, without limitation, tabs, loops or levers for directly or indirectly transmitting a force from a user to a portion of the container 10 for causing the container 10 to either move from the collapsed configuration toward the erected configuration or to move from the erected configuration toward the collapsed configuration, or for applying a restraining anchor force such as to control the bottom wall position while erecting the container 10. By way of non-limiting example, a user may grasp the extensions 112, 114 associated with end side walls 16, 20 to pivot the extensions 112, 114 and/or to push the extensions 112, 114 toward each other to cause the walls 12, 14, 16, 18, 20, 22, 48 of the container 10 to move toward the erected configuration.

As mentioned above, the extensions 112, 114 of the end side walls 16, 20 may be used to maintain the container 10 in the erected configuration by causing the extensions 112, 114 to be attached to an adjacent end side wall 18, 22. Such attachment of the extensions maintains the support structure 11 in a substantially rigid or semi-rigid configuration for providing the container 10 as a self supporting structure.

Figure 9:
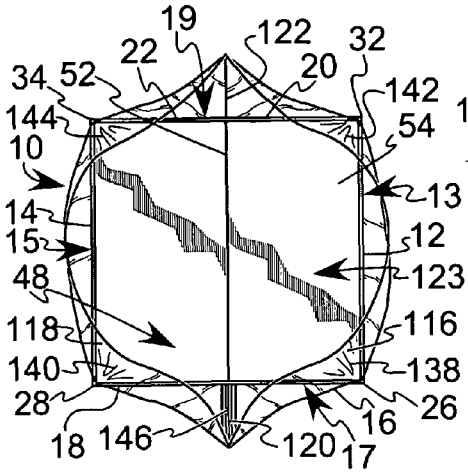
FIG. 9 is a top plan view of the container of FIG. 1.
Figure 10:
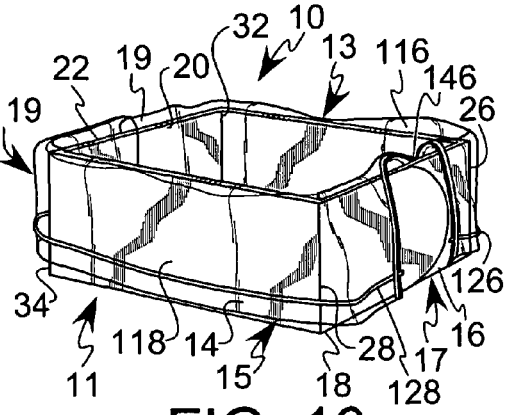
FIG. 10 is a perspective view of the container of FIG. 1 with the side panels folded down.

Movement of the side walls 12, 14, 16, 18, 20, 22 from the generally flat collapsed configuration toward the erected configuration causes the lower portions of the opposing side panels 116, 118 to separate from each other, and concurrently, the upper portions of the side panels 116, 118 may also separate to define an open mouth area for the container 10 through which articles or contents may be provided to or removed from the container 10. In the erected configuration, bend areas 138, 140, 142, 144 (FIGS. 1 and 9) are defined in the side panels 116, 118 adjacent the corners defined at the wall hinges 26, 28, 32, 34, where the curvature of the bend areas 138, 140 142, 144 tends to structurally stiffen the side panels 116, 118 and thereby bias the side panels 116, 118 to an orientation more aligned with the adjacent side walls 12, 14, 16, 18, 20, 22, to provide a more open passage for the container 10.

Additional structure may be provided to the side panels 116, 118 to facilitate maintaining the side panels 116, 118 in a more open state. Such additional structure may include, without limitation, a stay located at a mid-span location adjacent an edge of one or both of the side panels 116, 118 distal from the support structure 11, or positioned along other locations of the side panels 116, 118. The stay or stays may comprise flexible or rigid members, generally exhibiting some dead-fold or position lockable functionality for maintaining at least a portion of the side panels 116, 118 in a desired position. A stay exhibiting such functionality may comprise metal wire or thin sheet material, including fibrous papers and boardstocks, dead-foldable polymer sheet, and molded, formed, stamped or cut rigid parts with a lockable hinge-like mechanism. Other stay materials exhibiting similar functionality may also be used.

Alternatively, or additionally, the structure for biasing or maintaining the flexible panels 116, 118 in a more open position may comprise structure for facilitating maintaining the side panels 116, 118 more aligned with the adjacent side walls 12, 14, 16, 18, 20, 22. For example, means altering the material properties of the side panels 116, 118, including but not limited to force transmission elements or stiffening elements for transmitting forces between the side walls 12, 14, 16, 18, 20, 22 and the side panels 116, 118 may be provided.

Referring to FIGS. 9-12, the container 10 may further include means facilitating access to contents located in the container by manipulation of the side panels 116, 118. In particular, in the illustrated embodiment of the container 10, areas for separating the side panels 116, 118 from each other and/or from the side walls 12, 14, 16, 18, 20, 22 may be provided including, for example, a frangible portion 146 (see also FIG. 1) extending along at least one of the seam edges 120, 122, and may also include a frangible portion 148 extending adjacent an edge of the side walls 12, 14, 16, 18, 20, 22. In accordance with one method of providing access to the container 10, the side panels 116, 118 may be separated fully or partially along the at least one frangible portion 146 (FIG. 11), and the side panels 116, 118 may be folded and/or rolled over upon themselves and/or to a location adjacent the side walls 12, 14, 16, 18, 20, 22 (see FIG. 10). Optionally, a further frangible portion may be provided, such as at the other one of the seam edges 120, 122 or another location, to allow multiple sections of the side panels 116, 118 to be folded and/or rolled over to facilitate separation of the side panels 116, 118. Preferably, the separated material is separated in one piece; or alternatively in two or more pieces. The separated material may be fully removable from the container 10 or may still be attached at one or more points about which the material can be pivoted.

Figure 11:
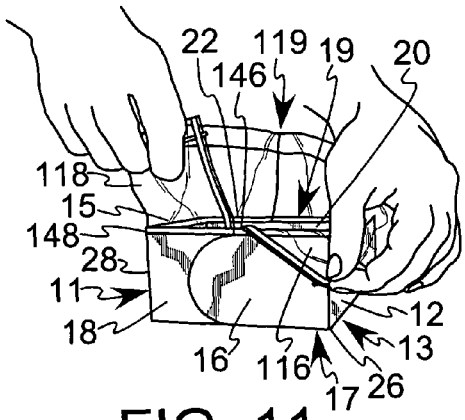
FIG. 11 is a perspective view of a step separating the side panels along a separation line extending along an edge of the side panels.
Figure 12:
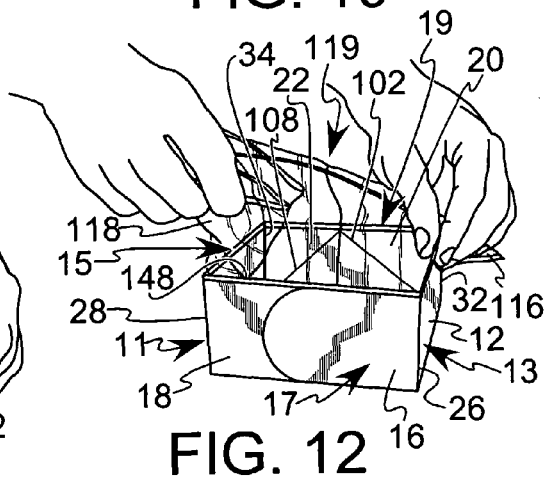
FIG. 12 is a perspective view of a further step separating a side panel along a separation line extending along a connection between the side panels and the support structure.
Figure 13:
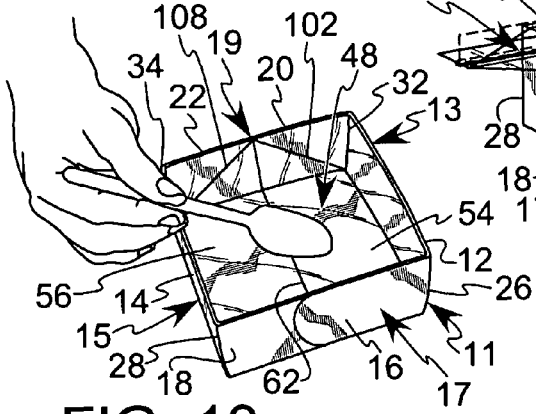
FIG. 13 is a perspective view of the support portion of the container after separation of the side panels.

In accordance with an alternative method of providing access to the container 10, the side panels 116, 118 may be separated along the at least one frangible portion 146, as seen in FIG. 11, and the side panels 116, 118 may be further separated from the side walls 12, 14, 16, 18, 20, 22 along the frangible portion 148, as seen in FIG. 12, to permit substantially complete removal of the side panels 116, 118 from the side walls 12, 14, 16, 18, 20, 22 (FIG. 13).

The frangible portions 146, 148 may be formed by predefined portions or lines of weakness and/or tear-oriented material properties. Examples of predefined portions or lines of weakness include, without limitation, perforations, mechanical or laser scores, intermittent or spaced score or embossed regions or points of weakness, material thinning and/or tear tapes positioned at or adjacent to desired separation locations. Alternatively, separation can occur along lines, portions or areas of releasable attachment such as lap, fin, butt seams or seals whether joined by adhesive, cohesive, heat seal, welding or other means. As a further alternative, a spanning material, e.g., pressure sensitive adhesive tape, may be torn or removed to cause separation of the panel(s). Additionally, means may be provided for facilitating the tear or separation process including without limitation anchor/pull tags, loops or other tactile means facilitating a user's identification of the frangible portion and/or to facilitate grip and/or force application to the container 10. Identification of the frangible portion or portions may further be facilitated by a visual indicator or indicators including without limitation color portions, such as applied or printed color strip(s) and/or a visually distinguishable material characteristic which may be located at or adjacent to the frangible portion and may include a visual indicator extending along either side of the frangible portion, such as may be provided by a visually identifiable laser score or area(s) exhibiting a difference in opacity or translucency relative to adjacent area(s). Further, tear prevention structure may be provided adjacent to the frangible portions to prevent the tear from propagating beyond the frangible portion.

Structure for facilitating access to the container 10 is not limited to manipulation of the side panels 116, 118. Additional, structure may be provided to the area of the support structure 11 defined by the side walls 12, 14, 16, 18, 20, 22, and may include removable or displaceable structure associated with one or more of the side walls 12, 14, 16, 18, 20, 22, permitting a portion or portions of the container 10 to be removed, reformed or otherwise manipulated to improve access to the interior of the container 10.

Figure 14:
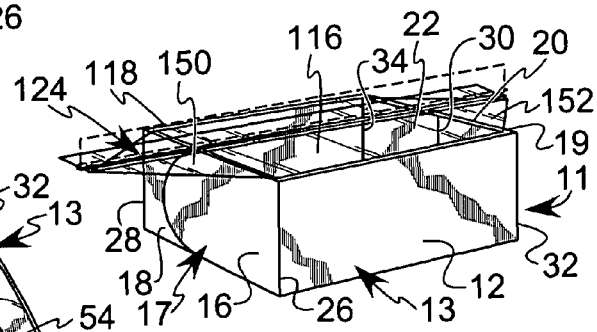
FIG. 14 is a perspective view of the container of FIG. 1 with the side panels joined together in a sealed configuration.
Figure 15:
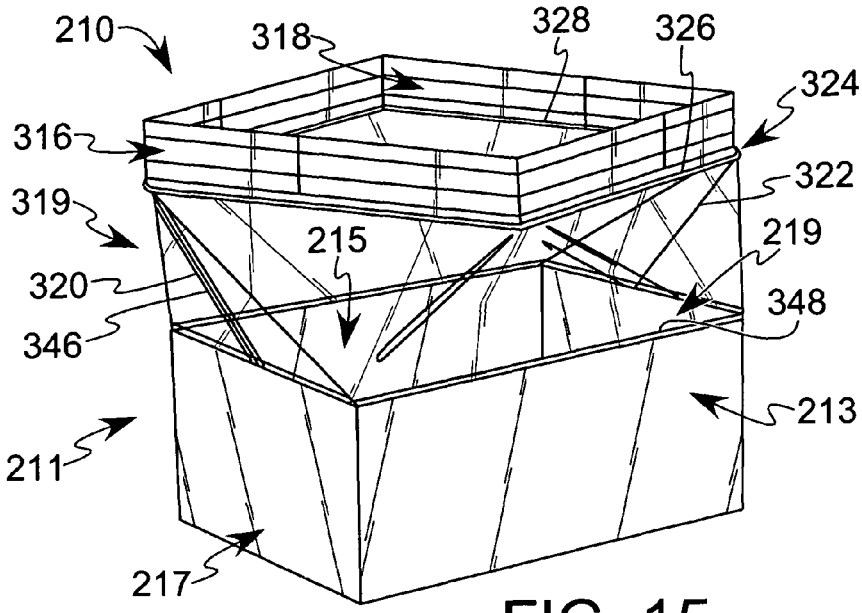
FIG. 15 is a perspective view of a container illustrating another embodiment of the present invention.

In one use of the container 10, the container 10 may be sealed and used for storage of any contents contained in the container 10. In such a use, edges of the side panels 116, 118 may be joined together, such as by means of the above-described reusable closure 124. Joining or engagement of the side panels 116, 118 together may be accompanied by a certain amount of movement of the side panels 116, 118 toward the support structure 11 resulting in formation of panel gussets 150, 152 (FIG. 14) as the top portions of the side panels 116, 118 are folded to substantially conform to a generally straight junction of the side panels 116, 118 extending across the top of the container 10 and past the locations of the pairs of end side panels 16, 18 and 20, 22. The folded state of the side panels 116, 118 defines a generally flat top surface for the container along a plane substantially coincident with edges of the side walls 12, 14, 16, 18, 20, 22. Accordingly, other containers may be stacked on the container 10 in a manner similar to the stackability provided by known rigid or semi-rigid storage containers.

The stackability of the container may be enhanced by providing additional structure including, without limitation, additional structure adjacent the top or bottom edges of the side panels 12, 14, 16, 18, 20, 22, such as a top rim providing a support upon which the bottom of a supported container may rest, flared structure comprising some or all of the side walls 12, 14, 16, 18, 20, 22 being outwardly angled at the upper or lower edges thereof to provide a positive engagement with engaged lower or upper edges of a supported or supporting container, or a rim extending transversely from an outwardly extending a flange adjacent the upper or lower edges of some or all of the side walls providing a ledge for engaging the lower or upper edges of a supported or supporting container. The structure facilitating stacking of containers 10 may be positioned exteriorly or interiorly of the flexible material 130 to function in direct contact with a stacked container or indirectly, through the flexible film, to facilitate stacking engagement. Other structures for facilitating alignment and or engagement of stacked containers may also be provided.

In general, the side and/or bottom walls may be positioned exteriorly or interiorly to the flexible material 130, either completely or in a combination of interior and exterior positions.

It should be understood that the present container 10 facilitates handling of the container 10, such as to lift/and or carry the container 10. In particular, the support structure 11 provided by at least the side walls 12, 14, 16, 18, 20, 22 may provide sufficient rigidity to the container 10 so that a user may grip opposing edges and/or side walls, e.g., opposing longitudinal walls 12, 14, to lift and/or carry the container 10. The container 10 may be provided with additional structure to facilitate handling of the container 10 including, without limitation, a tab or tabs, handle or strap formed as part of or attached to the side walls 12, 14, 16, 18, 20, 22 or the bottom wall 48. For example, a hand strap may be included to facilitate single handed lifting and/or carrying of the container 10, such as a strap provided to the bottom wall 48 to receive one or more fingers of a user and facilitating carrying of the container through support of the bottom wall 48.

Handling the container 10 may also be facilitated by structure provided on the side panels 116, 118. The container 10 may be lifted and/or carried by gripping the combined side panels 116, 118 between the user's fingers, as may be facilitated by a slip-resistant or other grip enhancing surface. Additional structure for enabling a user to grip the side panels 116, 118 include, without limitation, attached or integral tab(s), loop(s), handle hole(s) and/or strap(s).

In a use of the described container 10, the container may be provided in the collapsed configuration during storage or prior to use. Two or more containers 10 in the collapsed configuration may be provided with an outer package for convenient storage, distribution, sale and transport of multiple containers 10. The package may partially or fully enclose or envelope the containers 10. The package can be any known package including but not limited to bags, paper or plastic bands, shrink packages, shrink sleeves, stretch sleeves or bands, cartonboard packages, flow wrap packages, thermoformed packages, etc. Preferably, the package encloses or itself displays, illustrates or contains instructions for use of the containers 10, including erecting method(s). In a preferred retail store package, the package is itself either a consumer usable semi-rigid or rigid container or even an expanded erectable container 10.

During use, the container 10 may be transformed from the collapsed to erected configuration, as described above, where the support structure 12 defines a rigid or semi-rigid structure and the upper portion 119 defines a flexible bag-like structure that is openable for passage of contents. Contents may be placed in the container 10 through the opening 123, and the opening 123 sealed using the reusable closure 124. The container 10 and contents may be placed in a refrigerator or freezer, if appropriate, for storage and may be stacked with other containers 10 of similar construction if desired. Further, where the container 10 is formed of a microwavable material, the container 10 and enclosed contents may be placed directly in a microwave oven to reheat the contents directly in the container 10.

Referring to FIGS. 15-19 a further embodiment of a container 210 in accordance with the invention is illustrated, where elements generally corresponding to elements described for the container 10 are labeled with the same reference number increased by 200. The container 210 generally includes a support structure 211 and a bag-like upper portion 319 integrally attached to the support structure 211. The illustrated support structure 211 comprises four sides 213, 215, 217, 219 and a bottom wall 248, where the sides 213, 215, 217, 219 and bottom wall 248 may be substantially immovably connected together to provide a substantially rigid structure.

The upper portion 319 may comprise a pair of side panels 316, 318 formed of a flexible material and including a reusable closure 324, such as a closure comprising interlocking elements 326, 328 or any other closure elements as described above for the container 10. The side panels 316, 318 may be connected along edge seams 320, 322. Further, the materials forming the upper portion 319 and support structure 211 may comprise materials substantially similar to the materials described above for the corresponding elements of the container 10, where the material of the sides 213, 215, 217, 219 and bottom 248 may have a stiffness that is generally greater than the stiffness of the material forming the upper portion 319. As in the embodiment described with reference to the container 10, the upper portion 319 may be folded to a generally flat configuration extending substantially parallel to a plane of the upper edges of the sides 213, 215, 217, 219, i.e., a plane distal from the bottom wall 248, when the closure 324 is in a closed position.

Referring particularly to FIGS. 16-19, the container 210 may further include means facilitating access to contents located in the container by manipulation of the side panels 316, 318. In particular, in the illustrated embodiment of the container 210, portions for separating the side panels 316, 318 from each other and/or from the sides 213, 215, 217, 219 may be provided including, for example, a frangible portion or portions 346 extending along at least one of the edge seams 320, 322, and may also include a further frangible portion 348 extending adjacent an upper edge of the sides 213, 215, 217, 219. It may be noted that the frangible portion or portions 346 are not necessarily limited to the location of the edge seams 320, 322 and may extend toward the support structure 211 at an angle or along a curved path along either or both of the side panels 316, 318.

Figure 16:
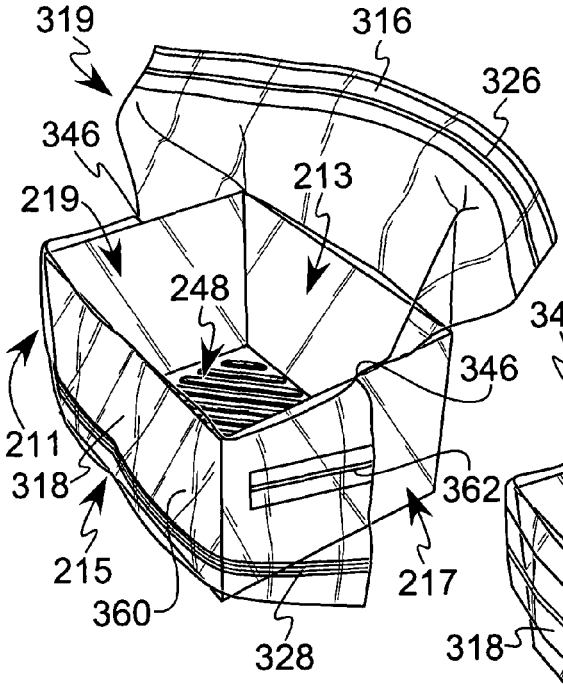
FIGS. 16 and 17 are perspective views of the embodiment of FIG. 15 illustrating steps of folding a side panel and implementing an interlocking structure to hold the side panel in a folded position.

In accordance with one method of providing access to the container 210, the side panels 316, 318 may be separated fully or partially along the at least one frangible portion 346, and the side panels 316, 318 may be folded and/or rolled toward the bottom wall 248 along the sides 213, 215, 217, 219, as illustrated in FIG. 16. In addition, the edge portion of the side panels 316, 318 including the reusable closure 324 may be folded back toward the open end of the container 210 and retained in position by a fastening structure, such that an outwardly facing surface 360 of the upper portion 319, defined by inner surfaces of the side panels 316, 318, is overlapped or covered by the folded portion or portions of the side panels 316, 318. Optionally, a further frangible portion may be provided, such as at the other one of the seam edges 320, 322 or another location, to allow multiple sections of the side panels 316, 318 to be folded and/or rolled over to facilitate separation of the side panels 316, 318.

Figure 17:
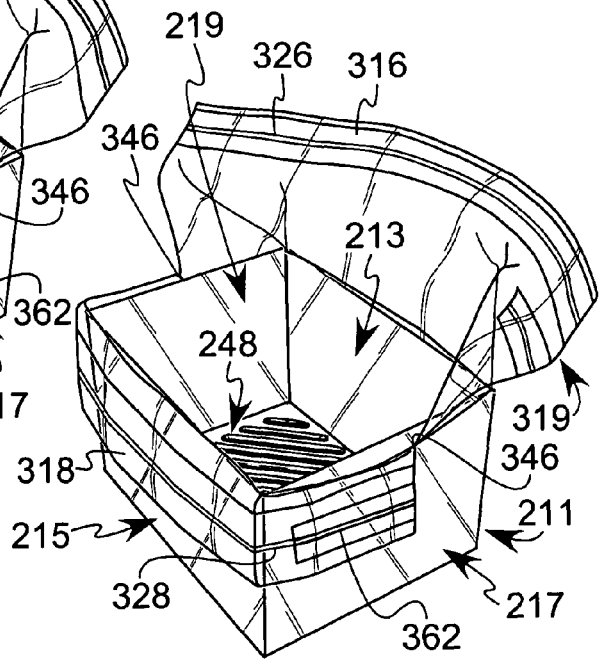

As illustrated in FIGS. 16 and 17, the fastening structure for retaining the folded edge portion of the side panels 316, 318 may comprise a section or sections of an interlocking closure element 362 located on the surface 360 of the upper portion 319 for cooperating and mating with at least one of the elements 326, 328 of the reusable closure 324. For example, after the upper portion 319 is folded toward the bottom wall 248 along the outside of the support structure 211, the edge portion of the side panels 316, 318 including the reusable closure 324 may be folded back toward the open end of the container 210 to position the reusable closure 324 in interlocking engagement with the interlocking closure element 362 located on the surface 360.

Figure 18:
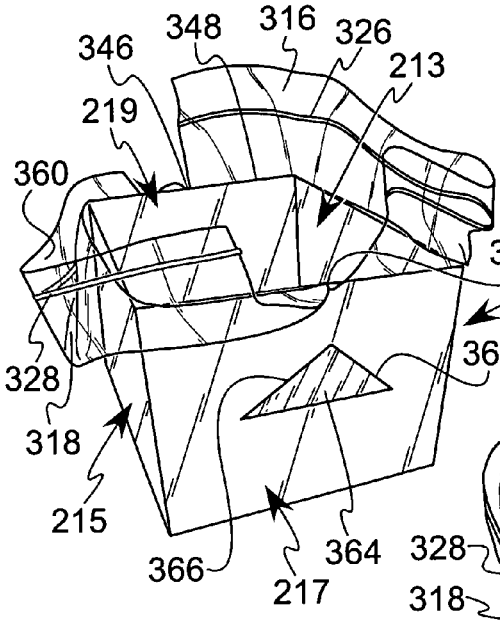
FIGS. 18 and 19 are perspective views of the embodiment of FIG. 15 illustrating steps of folding a side panel and implementing a pocket structure to hold the side panel in a folded position.
Figure 19:
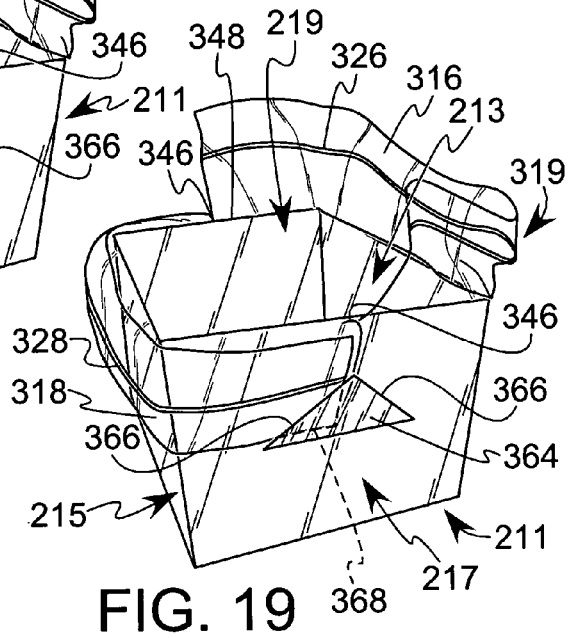

FIGS. 18 and 19 illustrate an alternative fastening structure for retaining the folded edge portion of the side panels 316, 318 in the folded position. The fastening structure may comprise a pocket structure 364 defining a pocket or pockets located on the support structure 211. The pocket structure 364 is illustrated as a triangular structure and may be located, for example, on one or more of the sides 213, 215, 217, 219 and defines a slit or slits 366, or similar structure, for receiving a corner 368 formed by folding the edge portion of the side panels 316, 318 toward the open end of the container 210 after the upper portion 319 is folded toward the bottom wall 248 along the outside of the support structure 211. Retention of the upper portion 319 in the described folded configuration is not limited to the mechanisms described above and may comprise other mechanisms including, without limitation, material retaining dimple(s) or aperature(s), hook and loop fasteners, adhesives including pressure sensitive adhesives, snap fit connections, clips, rubber bands, mechanical fasteners, grips and/or clamps.

In providing the container access illustrated in FIGS. 16-19, it is not necessary for the entire upper portion 319 formed by both side panels 316, 318 to be folded toward the bottom wall 248. For example, half of the upper portion 319, as defined by one of the side panels 316, 318 may be folded to provide access through one side of the upper portion 319. Alternatively, the side panels 316, 318 may be slit or tom along additional locations to provide access through an area less than or greater than the area defined by one of the side panels 316, 318.

In accordance with an alternative method of providing access to the container 210, the side panels 316, 318 may be separated along one or more of the frangible portions 346, and the side panels 316, 318 may be further separated from the sides 213, 215, 217, 219 along the further frangible portion 348 to permit substantially complete removal of the side panels 316, 318.

Figure 20:
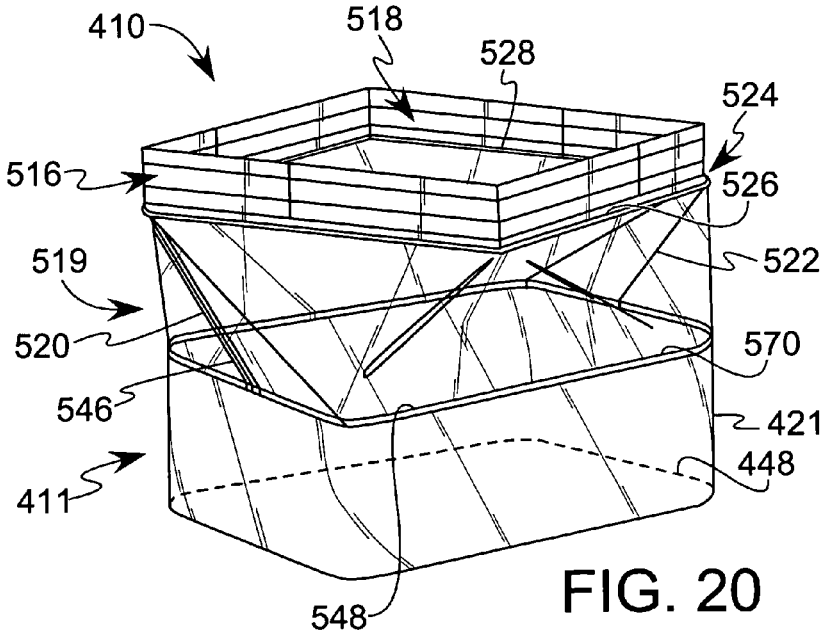
FIG. 20 is a perspective view of a container illustrating a further embodiment of the present invention.

Referring to FIG. 20 a further embodiment of a container 410 in accordance with the invention is illustrated, where elements generally corresponding to elements described for the container 10 are labeled with the same reference number increased by 400. The container 410 generally includes a support structure 411 and a bag-like upper portion 519 integrally attached to the support structure 411. The illustrated support structure 411 may comprise a molded structure, such as a molded plastic structure, defining a substantially rigid structure including an integrally formed side wall portion 421 and bottom wall portion 448.

The upper portion 519 may comprise a pair of side panels 516, 518 formed of a flexible material and including a reusable closure 524, such as a closure comprising interlocking elements 526, 528 or any other closure elements as described above for the container 10. The side panels 516, 518 may be connected along edge seams 520, 522. Further, the materials forming the upper portion 519 and support structure 411 may comprise materials substantially similar to the materials described above for the corresponding elements of the container 10, where the material of the side portion 421 and bottom portion 448 may have a stiffness that is generally greater than the stiffness of the material forming the upper portion 519. As in the embodiment described with reference to the container 10, the upper portion 519 may be folded to a generally flat configuration extending substantially parallel to a plane of the upper edge 570 of the side portion 421 when the closure 524 is in a closed position.

Frangible portions 546 and 548 may be provided to the container 410 in a manner similar to the embodiments illustrated by the containers 10 and 210 above to provide improved access by separating the upper portion 519 along one or more of the frangible portions 546, 548.

The dimension of the side portion 421 from the bottom portion 448 to the edge 570 of the side portion 421 adjacent the open end of the container 410 may be selected to provide a more bowl-like support structure 411 or a more tray-like support structure 411, depending on the designed application for the container 410. Further, a particular shape of the side portion 421 need not be a polygon shape and may comprise circular, oblong, elliptical and other shapes.

Alternative constructions are useful for certain situations, such as a container with plural compartments. For example, a divider, itself optionally erectable, may extend from the side walls and/or bottom wall, if present, to section the container into two or more compartments. Another example is a container with plural openings.

Not to be limiting, the present invention may contain liquids, solids, particles and combinations of contents thereof. Said contents may be an unlimited pallet of materials and articles to be used, for example for personal, household, industrial, automotive, hygienic, farming or pet maintenance purposes. Food stuff storage such as for human or animal purposes is a specific example. Further, the container may be partially or wholly collapsed prior to use, but pre-packed with contents such as the non-limiting examples of oil and popcorn kernels prior to popping; dried instant noodles and vegetables prior to addition of hot water for creating soup; dried pet food prior to addition of water; and seasonings prior to addition of other food ingredient(s).

All documents cited in the Detailed Description of the Invention are incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container comprising:

a structure comprising a side wall portion and a bottom wall portion;

an upper portion comprising a sheet of material integrally attached to said structure, said upper portion defining a closable opening for said container; and a frangible portion defined between said upper portion and said structure forming a predefined portion for separating at least a portion of said sheet of material from said structure.

2. The container of claim 1 wherein said frangible portion comprises predetermined portions of weakness in said sheet of material.

3. The container of claim 1 wherein said frangible portion comprises a score line.

4. The container of claim 1 including a further frangible portion located along said upper portion extending from said opening toward said structure and forming a predefined portion for separating adjacent portions of said sheet of material.

5. The container of claim 1 wherein said sheet of material is foldable along said side wall portion.

6. The container of claim 1 wherein said sheet of material has a flexural modulus of between 170,000 and 250,000 psi and a thickness of between 0.0005 and 0.01 inches.

7. The container of claim 6 wherein said structure has a flexural modulus of between 170,000 and 250,000 psi and a thickness of between 0.01 and 0.50 inches.

8. The container of claim 7 wherein said sheet of material comprises a flexible material.

9. The container of claim 1 wherein said sheet of material includes closure means for closing said opening.

10. The container of claim 9 wherein said upper portion comprises opposing panels and said closure means comprises interlocking elements located on said opposing panels.

11. A container comprising:

a structure comprising a side wall portion and a bottom wall portion;

an upper portion comprising a sheet of material integrally attached to said structure, said upper portion defining a closable opening for said container; and a frangible portion located along said upper portion extending from said opening toward said structure and forming a predefined portion for separating adjacent portions of said sheet of material.

12. The container of claim 11 including a fastening structure for maintaining a separated portion of said sheet of material in a folded configuration adjacent said structure.

13. The container of claim 12 wherein said fastening structure comprises a pocket located on said side wall portion for receiving a folded portion of said at least one side panel.

14. The container of claim 11 including a first interlocking closure element located on at least a portion of an interior surface of said sheet of material.

15. The container of claim 14 including a fastening structure comprising a second interlocking element located on said interior surface of said sheet of material for cooperating with said first interlocking closure element to hold said at least one side panel in a folded configuration.

16. A container comprising:

a structure comprising a side wall portion and a bottom wall portion, said side wall portion including an edge distal from said bottom wall portion;

an upper portion comprising a sheet of material defining opposing panels integrally attached to said structure, said upper portion defining a closable opening for said container; and a frangible portion defined between said upper portion and said structure forming a predefined portion for separating at least a portion of said sheet of material from said structure.

17. The container of claim 16 wherein said frangible portion extends substantially around said structure for separating substantially all of said upper portion from said structure at said edge of said side wall portion.

18. The container of claim 16 wherein said upper portion is foldable to substantially lie in a plane defined by said edge of said side wall portion.

19. The container of claim 16 wherein at least one of said opposing panels includes a closure element for engaging the other of said opposing panels to close said container.

20. The container of claim 16 wherein at least one of said opposing panels is foldable along said side wall portion.

* * * * *